US007316587B2

(12) United States Patent
Chien et al.

(10) Patent No.: US 7,316,587 B2
(45) Date of Patent: Jan. 8, 2008

(54) AUDIO JACK

(75) Inventors: Min-Ling Chien, Taipei Hsien (TW); Kai-Ray Cheng, Taipei Hsien (TW); Jian Cheng, Taipei Hsien (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/534,866

(22) Filed: Sep. 25, 2006

(65) Prior Publication Data

US 2007/0123111 A1 May 31, 2007

(30) Foreign Application Priority Data

Nov. 25, 2005 (TW) ..... 94220529 U

(51) Int. Cl.
*H01R 24/04* (2006.01)

(52) U.S. Cl. ..... 439/668; 439/489

(58) Field of Classification Search ..... 439/668, 439/489

See application file for complete search history.

(56) References Cited

U.S. PATENT DOCUMENTS 6,056,602 A * 5/2000 Wu ..... 439/668
6,220,898 B1 * 4/2001 Wu ..... 439/668
6,540,564 B1 * 4/2003 Ko ..... 439/676

* cited by examiner

*Primary Examiner*—Truc Nguyen

(57) ABSTRACT

An audio jack includes a rectangular housing including a body including a rear first compartment and a hole extended from a front face to the first compartment, and an insulate plate secured to a top of the body; a plurality of contacts provided in the housing and including first, second, third, fourth, and fifth contacts each including a flexible portion and an upright solder portion; a light emitting element provided in the first compartment and aligned with the hole and including legs inserted through the first compartment; and a shell secured onto the housing. Inserting a first plug into the hole until the contact assembly is electrically connected with the plug will effect an analog signal transmission. Inserting a second plug into the hole until its head is electrically connected with the light emitting element will effect a digital signal transmission. The plate together with the shell can provide a double shield.

6 Claims, 5 Drawing Sheets

AUDIO JACK

BACKGROUND OF THE INVENTION

1. Field of Invention

The present invention relates to audio jacks and more particularly to such an audio jack capable of transmitting analog signals and digital signals.

2. Description of Related Art

Conventionally, an audio jack is employed as an effective medium for signal transmission between two communication devices (e.g., mobile phones, PDAs (Personal Digital Assistants), MP3s, or the like).

Typically, a plug is inserted into an audio jack for transmitting analog signals. However, analog signals are susceptible to interference. Thus, its quality is poor. Nowadays, digital signals are employed as means for data communication. However, some types of audio jack are for digital signal transmission only. Hence, they are experienced many problems in analog signal transmission. For other some types of audio jack for analog signal transmission, they are also experienced many problems in digital signal transmission.

One prior art solution is that one audio jack for analog signal transmission and the other audio jack for digital signal transmission are provided on a circuit board. However, it undesirably occupies much precious space. Further, latch mechanism mounted in the prior art audio jack is typically relatively complex in constructions, costly to manufacture, uneasy to assembly, and trouble-prone. Thus, the need for improvement still exists.

SUMMARY OF THE INVENTION

It is therefore one object of the present invention to provide an audio jack comprising an insulative housing having a hole, a plurality of contacts in the housing, and a light emitting element in the housing such that inserting a first type of plug into the hole until the contact assembly is electrically connected with the plug will effect an analog signal transmission; and inserting a second type of plug into the hole until a head of the plug is electrically connected with the light emitting element will effect a digital signal transmission.

It is another object of the present invention to provide an audio jack comprising an insulative housing having an insulative plate, and a shell such that a double shield is provided to the audio jack.

It is a further object of the present invention to provide an audio jack having a latch mechanism being advantageous for relatively simple constructions, easy to assembly, and effective in the manufacturing cost.

To achieve the above and other objects, the present invention provides an audio jack comprising a rectangular housing including a body including a rear first compartment and a hole extended from a front face to the first compartment, and an insulate plate secured to a top of the body; a plurality of contacts provided in the housing and including first, second, third, fourth, and fifth contacts each including a flexible portion and an upright solder portion; a light emitting element provided in the first compartment and aligned with the hole and including a plurality of legs inserted through the first compartment; and a shell secured onto the housing. A plug is adapted to insert into the hole to electrically couple to the light emitting element.

The above and other objects, features and advantages of the present invention will become apparent from the following detailed description taken with the accompanying drawings.

DETAILED DESCRIPTION OF THE INVENTION

Figure 1:
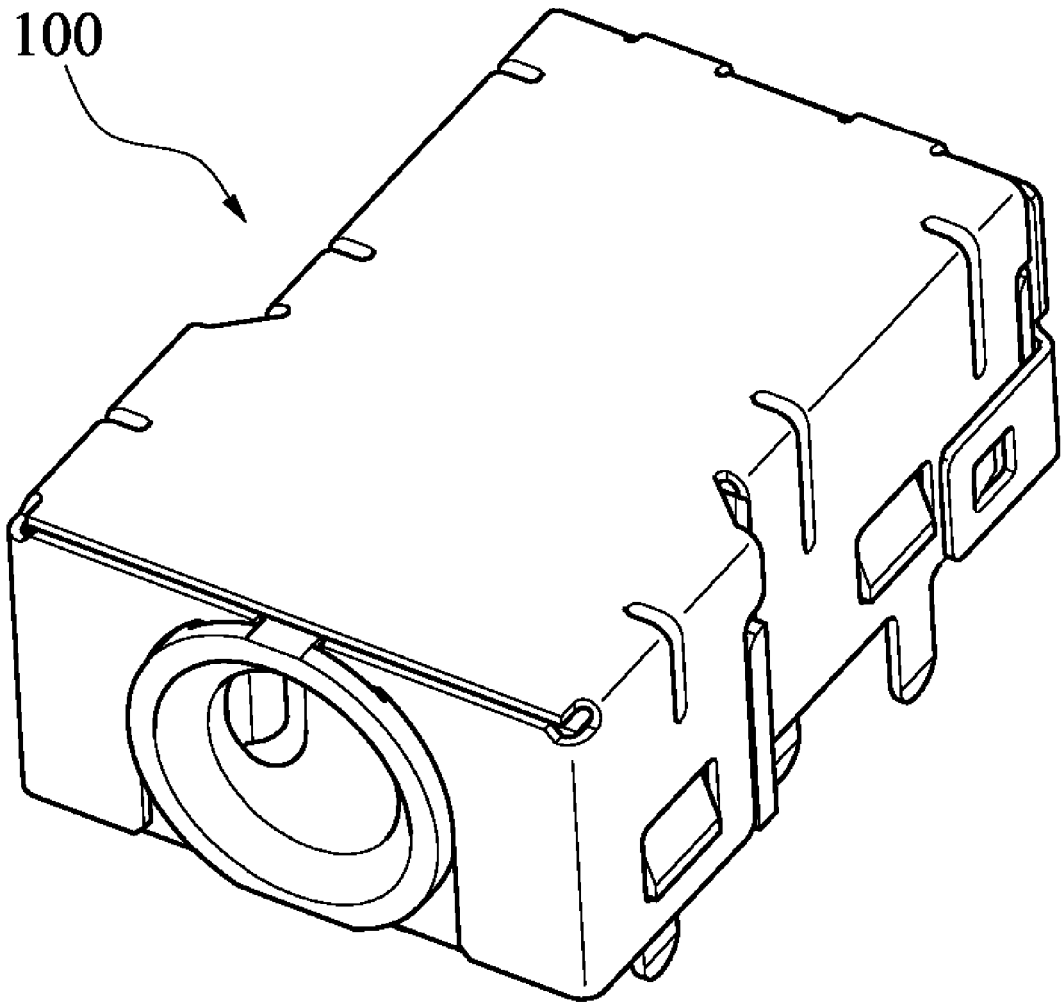
FIG. 1 is a perspective view showing a preferred embodiment of audio jack according to the invention.
Figure 2:
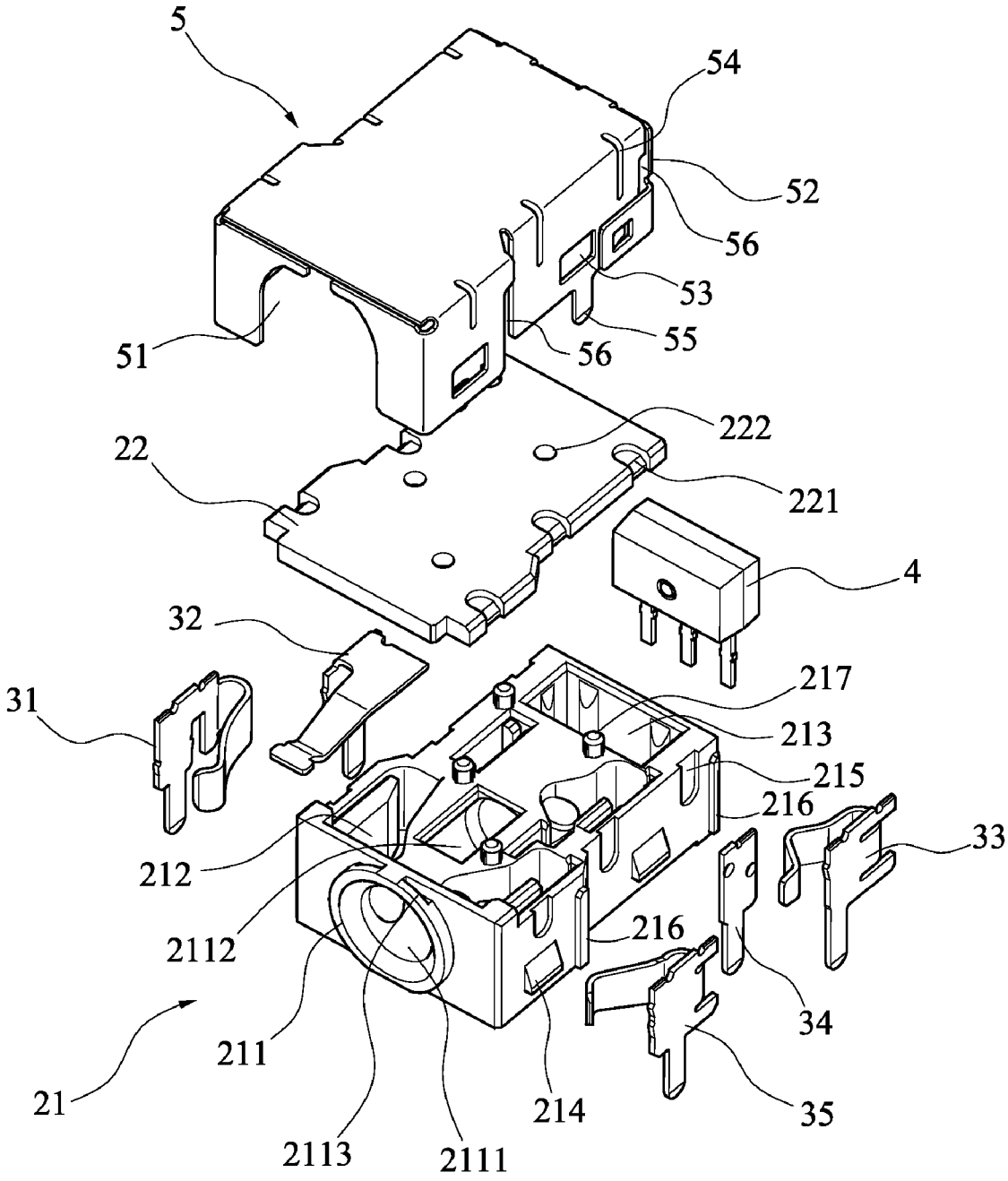
FIG. 2 is an exploded view showing the audio jack shown in FIG. 1.
Figure 3:
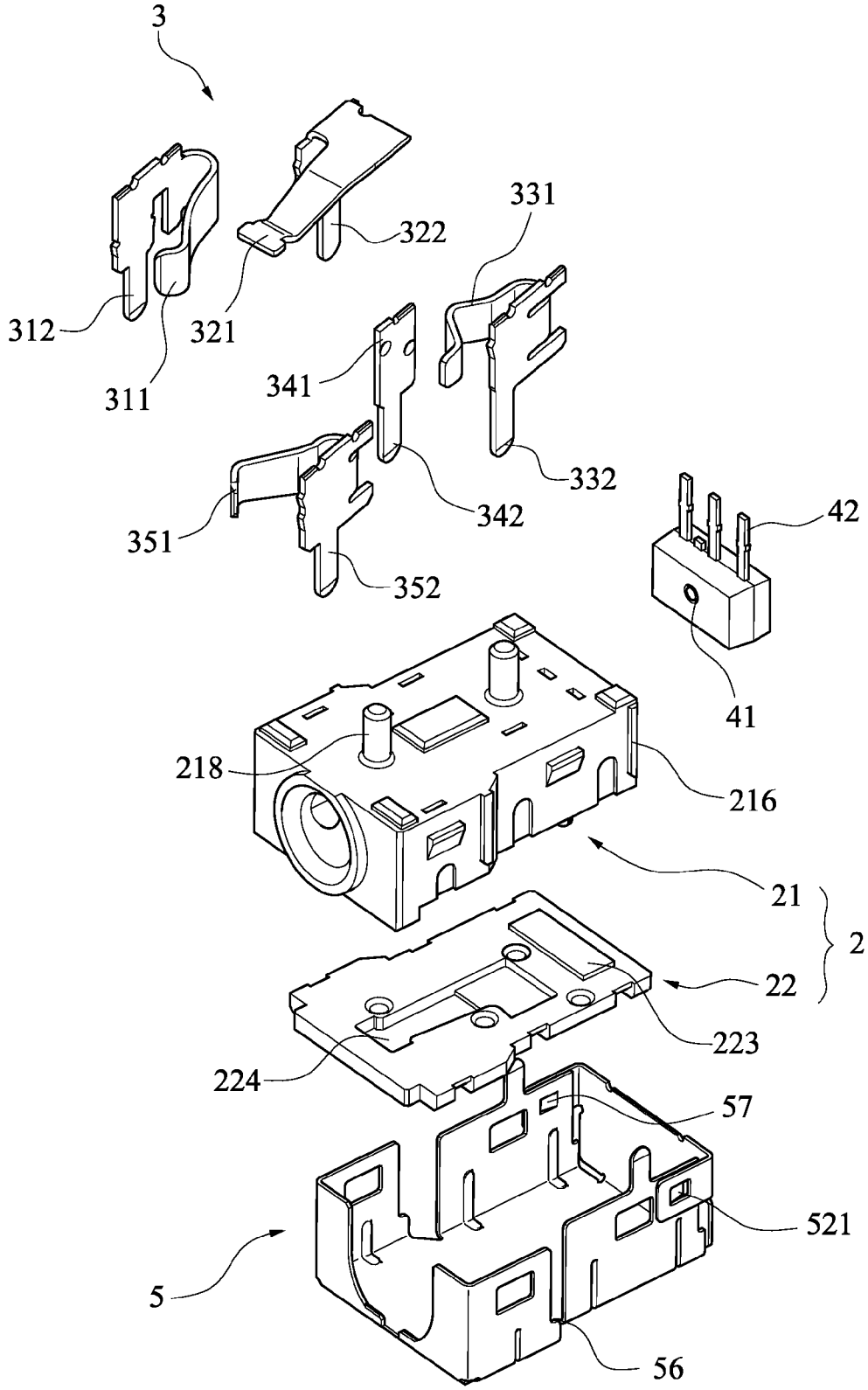
FIG. 3 is another exploded view showing the upside down audio jack shown in FIG. 1.
Figure 4:
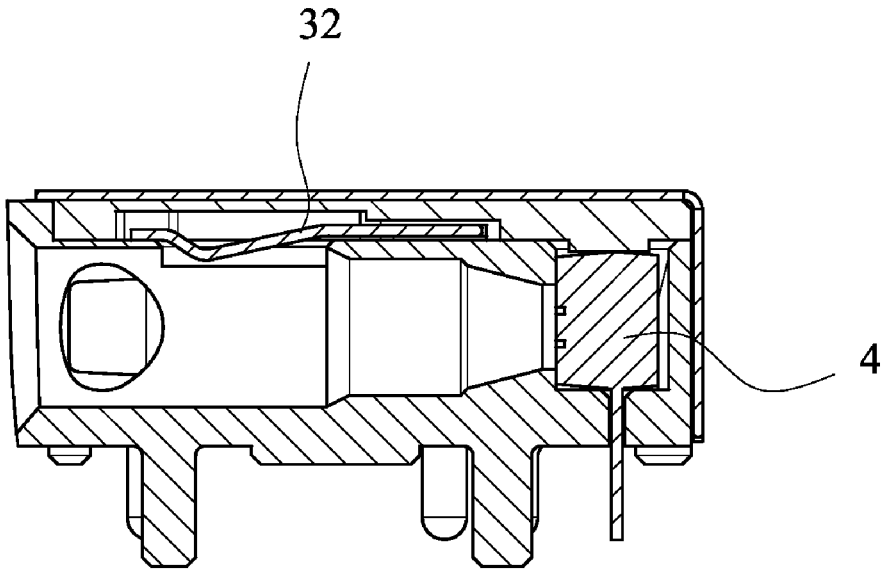
FIG. 4 is a longitudinal cross-sectional view showing the audio jack shown in FIG. 1.
Figure 5:
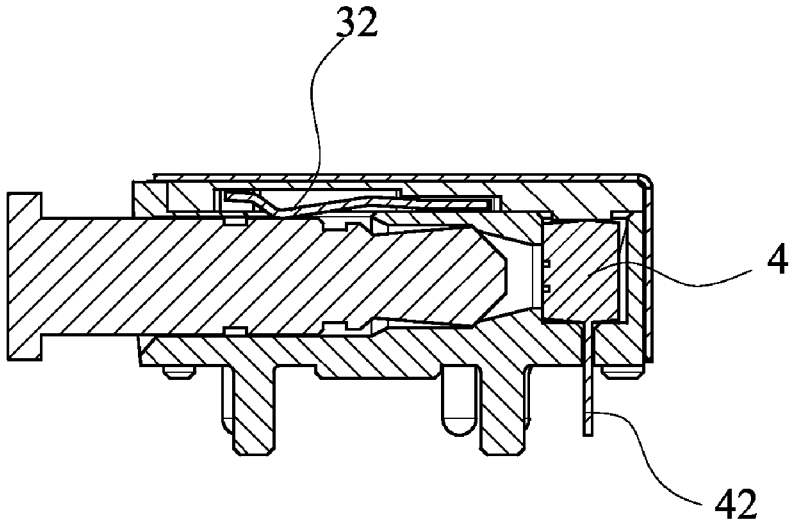
FIG. 5 is a longitudinal cross-sectional view illustrating a plug inserted into the audio jack shown in FIG. 1.
Figure 6:
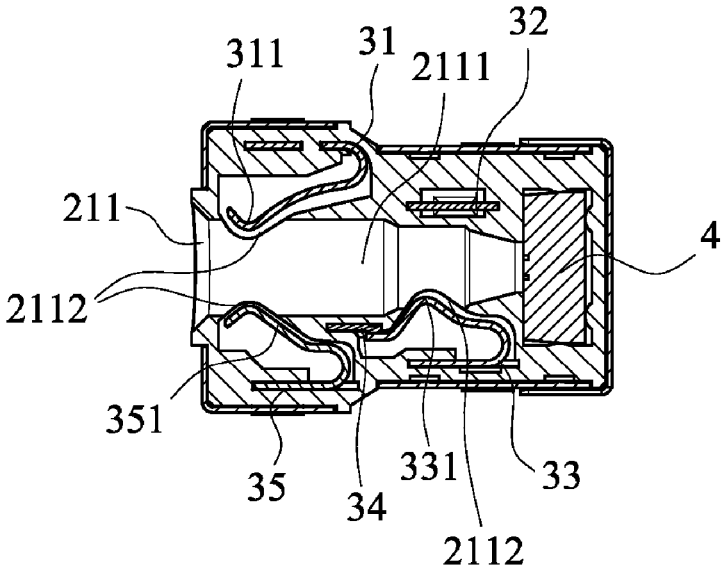
FIG. 6 is a transversal cross-sectional view showing the audio jack shown in FIG. 1.
Figure 7:
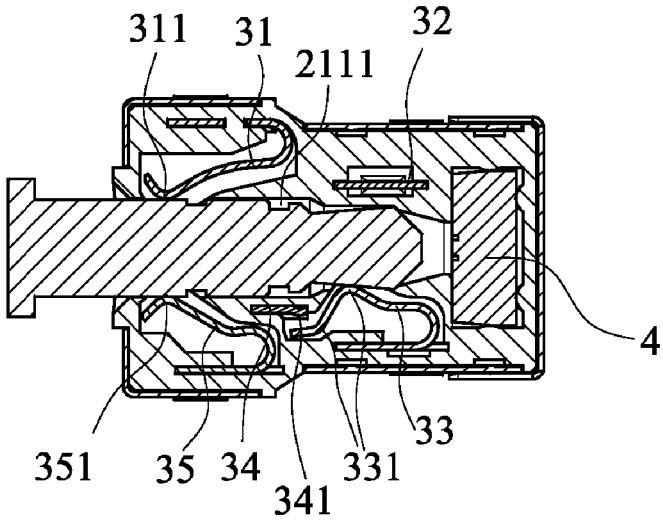
FIG. 7 is a transversal cross-sectional view of the plug inserted into the audio jack showing the audio jack shown in FIG. 1.

Referring to FIGS. 1 to 7, an audio jack 100 in accordance with a preferred embodiment of the invention comprises an insulative housing 2, a plurality of contacts 3, a light emitting element 4, and a shell 5. Each component is discussed in detailed below.

The housing 2 comprises a body 21 and an insulative plate 22 both of rectangular. The body 21 comprises a hole 2111 having a rim mouth 211 formed on a front face. The hole 2111 is extended inward to terminate at the light emitting element 4 in a rear. A plug 6 is adapted to insert into the hole 2111. Top and two sides of an inner surface of the hole 2111 are formed with a cut 2112 respectively. A plurality of second compartments 212 of different shapes are formed at both sides of the hole 2111 of the body 21 with the contact assembly 3 provided therein. A rectangular first compartments 213 is formed at the rear of the body 21. A depression 2113 is formed on the mouth 211 and mates with a front, curved recess 51 of the shell 5. A plurality of latches 214 are provided on both sides of the body 21 and mate with a plurality of openings 53 on both sides of the shell 5. A plurality of first wells 215 are formed on both sides of the body 21 and are disposed above the latches 214. A plurality of second wells 221 are formed on both sides of the plate 22 and are aligned with the first wells 215. Thus, a plurality of L-shaped wells are formed by the corresponding first and second wells 215 and 221 when the body 21 and the plate 22 are secured together. A plurality of L-shaped projections 54 are formed on both sides and top of the shell 5. The projections 54 are adapted to insert into the wells for fastening. Two intermediate and rear upright protrusions 216 are formed on both sides of the body 21. Two intermediate and rear upright slots 56 are formed on both sides of the shell 5. The intermediate and rear upright protrusions 216 are adapted to insert into the slots 56 for fastening. By configuring a latch mechanism as above, the assembly of the audio jack 100 and the plug 6 is very simple. Also, the coupling of the shell 5 and the housing 2 is secure.

In a case of the plate 22 coupled to the body 21, a plurality of top stubs 217 of the body 21 are inserted into a plurality of conformed through apertures 222 of the plate 22 for securing the plate 22 onto the body 21. A rectangular protuberance 223 on a bottom of the plate 22 is urged against the light emitting element 4 for fastening the light emitting element 4 in the first compartment 213 of the body 21. In addition, the light emitting element 4 has three legs 42 inserted through holes on the bottom of the first compartment 213. A staged cavity 224 is formed on the bottom of the plate 22 in front of the protuberance 223. Two pegs 218 are formed on a lengthwise center line of bottom of the body 21.

The contact assembly 3 comprises a first contact 31, a second contact 32, a third contact 33, a fourth contact 34, and a fifth contact 35. Each of the contacts 31, 32, 33, 34, and 35 comprises a flexible portion 311, 321, 331, 341, or 351, and an upright solder portion 312, 322, 332, 342, or 352. The contact 321 of the second contact 32 is shaped to urge against the cavity 224 by inserting the plug 6 into the hole 2111. As such, the plate 22 is securely engaged with top of the body 21, resulting in a shielding of the audio jack 100.

The first contact 31 is provided at one side of the hole 2111 and both the third contact 33 and the fifth contact 35 are provided at the other side thereof. Also, the contacts 311, 331, and 351 are extended through the cuts 2112 to urge against the plug 6. The second contact 32 is provided in the body 21 proximate one side thereof. Also, the solder portion 322 of the second contact 32 is provided at one side of the hole 2111 and the contact 321 thereof is inserted through the top cut 2112 to urge against the plug 6. The fourth contact 34 is provided at the other side of the hole 2111 between the third contact 33 and the fifth contact 35. The contact 341 is not engaged with the plug 6. Instead, the contact 341 is adapted to engage with the contact 331 of the third contact 33 to form a switch (see FIG. 6). That is, in a case of the plug 6 inserted into the hole 2111 to engage with the contact 331 of the third contact 33, the contact 341 of the fourth contact 34 is disengaged with the third contact 33 (see FIG. 7). As a result, signal transmission is made possible.

The shell 5 is formed integrally and has an inverted U section. The shell 5 further comprises a leg 55 at either side to be inserted into a PCB (printed circuit board) (not shown). A rear cap 52 is formed by downward bending a top of the shell 5. The cap 52 comprises two side extensions 520 having an opening 521 adapted to lockingly receive a rear latch 57 at either side of the shell 5. By configuring the shell 5 as above, the housing 2 is substantially covered by the shell 5, resulting in a shielding of the audio jack 100. This is a shield in addition to the plate 22. As an end, interference is substantially eliminated with an increase of the signal transmission quality.

In operation, for analog signal transmission insert a first type of plug into a front hole of an audio jack until contacts of a plurality of contacts are electrically connected with the plug. To the contrary, for digital signal transmission insert a second type of plug into the front hole of the audio jack until a head of the plug is electrically connected with a light emitting element.

While the invention herein disclosed has been described by means of specific embodiments, numerous modifications and variations could be made thereto by those skilled in the art without departing from the scope and spirit of the invention set forth in the claims.

What is claimed is:

1. An audio jack comprising:

a rectangular housing including: a body having a rear first compartment formed with a hole extending from a front face thereof to the first compartment, and an insulate plate secured to a top of the body;

a plurality of contacts provided in the housing, the contacts including a first contact, a second contact, a third contact, a fourth contact, and a fifth contact, each of the contacts including a flexible portion and an upright solder portion;

a light emitting element provided in the first compartment and aligned with the hole, the light emitting element including a plurality of legs inserted through the first compartment; and a shell secured onto the housing;

wherein the plate comprises a bottom protuberance urged against the light emitting element, and a cavity formed on its bottom in front of the protuberance; wherein the flexible portion of the second contact is urged against the cavity.

2. The audio jack as recited in claim 1, wherein the shell has an inverted-U section and comprises a front, curved recess, two legs at both sides, two rear latches at both sides, a plurality of intermediate openings on both sides, a plurality of L-shaped projections on both sides and a top, two intermediate and rear upright slots on both sides, and a rear cap formed by downward bending its top, the cap including two side extensions having an opening for securely receiving the latch.

3. The audio jack as recited in claim 2, wherein the hole comprises a depression formed on its mouth, the depression adapted to be mated with the recess of the shell.

4. The audio jack as recited in claim 2, wherein the body further comprises a plurality of latches on both sides, the latches adapted to be mated with the openings of the shell for fastening.

5. The audio jack as recited in claim 2, wherein the body further comprises a plurality of upper first wells formed on both sides thereof, wherein the plate further comprises a plurality of second wells formed on both sides thereof and aligned with the first wells so as to form a plurality of L-shaped wells; wherein the projections of the shell are adapted to insert into the L-shaped wells for fastening.

6. The audio jack as recited in claim 2, wherein the body further comprises two intermediate and rear upright protrusions formed on both sides thereof, the intermediate and rear upright protrusions adapted to securely insert into the intermediate and rear upright slots of the shell for fastening.

* * * * *